US009224252B1

(12) United States Patent
Guo et al.

(10) Patent No.: US 9,224,252 B1
(45) Date of Patent: Dec. 29, 2015

(54) METHOD OF DIAGNOSING THE RATIONALITY OF A HUMIDITY SENSOR OUTPUT SIGNAL

(71) Applicants: Yichao Guo, Rochester Hills, MI (US); Robert Stack, Grand Blanc, MI (US)

(72) Inventors: Yichao Guo, Rochester Hills, MI (US); Robert Stack, Grand Blanc, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 14/338,382

(22) Filed: Jul. 23, 2014

(51) Int. Cl.
*F02D 13/02* (2006.01)
*G07C 5/08* (2006.01)

(52) U.S. Cl.
CPC ..... *G07C 5/0808* (2013.01)

(58) Field of Classification Search
CPC ..... F02D 2200/0418; F02D 41/1441; F02D 41/222; F02D 2041/1472; H01M 8/04126; H02K 11/001; Y02T 10/40
USPC ..... 701/33.5, 36, 43; 123/690, 568.16, 123/677–680; 62/176.1
See application file for complete search history.

(56) References Cited

U.S. PATENT DOCUMENTS

| | | | | |
|---|---|---|---|---|
| 7,715,976 | B1 | 5/2010 | Xiao et al. | |
| 2004/0237646 | A1 * | 12/2004 | Fujita et al. | 73/335.05 |
| 2005/0072404 | A1 * | 4/2005 | Cullen | 123/399 |
| 2005/0072411 | A1 * | 4/2005 | Cullen | 123/690 |
| 2009/0254245 | A1 | 10/2009 | Bauerle | |
| 2012/0227714 | A1 | 9/2012 | Surnilla et al. | |

* cited by examiner

*Primary Examiner* — Dalena Tran
(74) *Attorney, Agent, or Firm* — Ralph E. Smith

(57) ABSTRACT

A method of diagnosing rationality of a humidity sensor output signal determines that the humidity sensor output signal has passed a rationality diagnostic if the output signal is changing sufficiently. If the output signal is not changing sufficiently, the method determines whether it should be changing sufficiently by whether a humidity capacity index determined based on temperature and pressure local to the humidity sensor is changing sufficiently. If the humidity capacity index is changing sufficiently and the humidity sensor output signal is not, the method determines that the humidity sensor output signal has failed a diagnostic check. Upon determining that the humidity sensor output signal has failed the diagnostic check a predetermined number of times, the method determines that the humidity sensor output signal has failed the rationality diagnostic.

7 Claims, 7 Drawing Sheets

METHOD OF DIAGNOSING THE RATIONALITY OF A HUMIDITY SENSOR OUTPUT SIGNAL

FIELD

The present invention relates to on board diagnostics in vehicles, and more particularly to a method of diagnosing in a vehicle the rationality of a humidity sensor output signal.

BACKGROUND

Humidity is often a parameter used by engine management systems of vehicles in controlling exhaust gas recirculation ("EGR"), such as controlling an exhaust gas recirculation valve. Such engines thus typically have a humidity sensor or sensors coupled to an electronic control unit ("ECU") of the engine management system that includes memory and software programmed therein that provides the control for the various functions of the engine management system, including control of the EGR. In particular, moisture build-up at the EGR valve can lead to icing of the EGR valve. The engine management system manages gas flow to the EGR valve to avoid icing of the EGR valve.

Since the humidity sensor impacts emissions' control, a diagnostic for the humidity sensor is included in the on-board diagnostics ("OBD") of the vehicle's engine management system. A humidity sensor diagnostic typically requires a reference against which to compare the relative humidity sensed by the humidity sensor. Prior art approaches have addressed this such as by providing a second humidity sensor to provide the reference or to use a secondary source such as a weather station to obtain the relative humidity for an area in which the vehicle is in and communicate this data to the vehicle for use in the OBD humidity sensor output signal rationality diagnostic.

SUMMARY

In an automotive vehicle having an internal combustion engine, a humidity sensor in an intake manifold of the engine and an engine management system configured to control the engine, the humidity sensor coupled to the engine management system, a method of diagnosing rationality of a humidity sensor output signal sensor with the engine management system, includes performing an onboard humidity sensor rationality diagnostic with the engine management system that includes continuously performing diagnostic loops with the engine management system when the engine is running. Each diagnostic loop includes: reading the humidity sensor output signal with the engine management system; determining with the engine management system a humidity capacity index based on pressure and temperature local to the humidity sensor; determining with the engine management system whether the humidity sensor output signal has passed the rationality diagnostic based on whether the humidity sensor output signal has changed from a prior reading by at least a predetermined humidity test threshold and determining that the humidity sensor passed the rationality diagnostic upon determining that the humidity sensor output signal has changed from the prior reading by at least the predetermined humidity test threshold. Upon determining that the humidity sensor output signal did not pass the rationality diagnostic, determining with the engine management system whether the humidity sensor output signal should have changed by the predetermined humidity test threshold based on whether the determined humidity capacity index has changed from a prior determined humidity capacity index by at least a predetermined humidity capacity index threshold and determining that the humidity sensor output signal failed the diagnostic check upon determining that the humidity sensor output signal should have changed by a at least second predetermined humidity test threshold and did not. The method further includes determining with the engine management system that the humidity sensor output signal has failed the rationality diagnostic upon determining that the humidity sensor has failed the diagnostic check a predetermined number of times and upon determining that the humidity sensor output signal has experienced a failure of the rationality diagnostic, generating with the engine management system a failure report that includes setting a fault code in memory of the engine management system and also setting with the engine management system a user recognizable alert.

In an aspect, each diagnostic loop includes a bookkeeping module and a pass/fail module with the bookkeeping module performed before the pass/fail module. Performing the bookkeeping module with the engine management system includes the reading the humidity sensor output signal with the engine management system and the determining with the engine management system a current humidity capacity index based on pressure and temperature local to the humidity sensor. This further includes determining with the engine management system whether to initialize test data stored in a memory of the engine management system, the test data including minimum and maximum relative humidity values and minimum and maximum humidity capacity index values and upon determining with the engine management system that the test data is to be initialized, initializing the test data with the engine management system by replacing both the minimum and maximum relative humidity values stored in memory with a current relative humidity value obtained by the reading of the humidity sensor output signal and replacing both the minimum and maximum humidity capacity index values stored in memory with the determined humidity capacity index wherein determining the humidity capacity index with the engine management system based on pressure and temperature local to the humidity sensor includes determining the humidity capacity index based on pressure and temperature sensed by pressure and temperature sensors co-located with the humidity sensor, the pressure and temperature sensors coupled to the engine management system. Performing the bookkeeping module further includes updating with the engine management system the minimum value of relative humidity stored in the memory of the engine management system by replacing it with the current relative humidity value if the current relative humidity value is less than the stored minimum relative humidity value and updating the maximum value of relative humidity stored in the memory of the engine management system by replacing it with the current relative humidity valve if the current relative humidity value is greater than the stored maximum humidity value. Performing the bookkeeping module also includes updating with the engine management system the minimum value of the humidity capacity index stored in the memory of the engine management system by replacing it with the determined humidity capacity index if the determined humidity capacity index is less than the stored minimum humidity capacity index value and updating the maximum humidity capacity index value stored in the memory of the engine management system by replacing it with the determined humidity capacity index value if the determined humidity capacity index value is greater than the stored maximum humidity capacity index value.

In an aspect, performing the pass/fail module with the engine diagnostic system includes the determination of whether the humidity sensor output signal has passed the rationality diagnostic, whether the humidity sensor output signal has failed the diagnostic check and whether the humidity sensor output signal has failed the rationality diagnostic. This further includes determining with the engine management system that the humidity sensor output signal has passed the rationality diagnostic if the stored minimum and maximum humidity values differ from each other by at least the predetermined humidity test threshold and upon determining that the humidity sensor output signal has passed the rationality diagnostic generating with the engine management system a pass report for processing by an onboard diagnostic manager of the engine management system, resetting with the engine management system a fail counter of the rationality diagnostic and causing the engine management system to initialize the test data when next performing the bookkeeping module with the engine management system. Performing the pass/fail module also includes determining with the engine management system that the humidity sensor output signal has failed the diagnostic check if the stored minimum and maximum humidity values do not differ from each other by at least the second predetermined humidity test threshold, that the stored maximum and minimum humidity capacity index values differ from each by at least the predetermined humidity capacity index threshold and that the relative humidity sensed by the humidity sensor is not at a high or low extreme ambient condition, and upon determining with the engine management system that the humidity sensor output signal has failed the diagnostic check, incrementing with the engine management system the fail counter and causing the engine management system to initialize the test data when next performing the bookkeeping module. Performing the pass/fail module further includes determining with the engine management system that the humidity sensor output signal has failed the rationality diagnostic when the fail counter reaches a predetermined number and upon determining that the humidity sensor output signal has failed the rationality diagnostic, in addition to generating the failure report and setting the user recognizable alert also resetting with the engine management system the fail counter and causing the engine management system to initialize the test data when next performing the bookkeeping module.

In an aspect, determining that the humidity sensor output signal failed the diagnostic check upon determining that the stored minimum and maximum humidity values do not differ from each other by at least the second predetermined humidity test threshold includes if the determined humidity capacity index increased from the prior determined humidity capacity index, making the determination using the second predetermined humidity test threshold and if the determined humidity capacity index decreased from the prior determined humidity capacity index, making the determination using a third predetermined humidity test threshold instead of the second predetermined humidity capacity index.

In an aspect, determining with the engine management system that the humidity sensor has failed the diagnostic check also requires either: determining with the engine management system that the minimum and maximum humidity values do not differ from each by at least a second predetermined humidity test threshold after determining with the engine management system that the current humidity capacity index is increasing and that the minimum relative humidity value is less than or equal to a high relative humidity threshold; or determining with the engine management system that the minimum and maximum humidity values do not differ from each by at least a third predetermined humidity test threshold after determining with the engine management system that the current humidity capacity index is decreasing and that the maximum relative humidity value is greater than or equal to a low relative humidity threshold. In an aspect, the low relative humidity threshold is fifteen percent and the high relative humidity threshold is eighty-five percent.

In an aspect, each diagnostic loop also includes an enable module performed before the bookkeeping module and performing the enable module with the engine management system includes determining whether all enabling conditions are present for proceeding to perform the bookkeeping module and proceeding to perform the bookkeeping module only upon determining that all the enabling conditions are present.

In an aspect, determining that the humidity sensor output signal failed the diagnostic check upon determining that the humidity sensor output signal should have changed by at least the second predetermined humidity test threshold and did not includes if the determined humidity capacity index increased from the prior determined humidity capacity index, making the determination using the second predetermined humidity test threshold and if the determined humidity capacity index decreased from the prior determined humidity capacity index, making the determination using a third predetermined humidity test threshold instead of the second predetermined humidity capacity index.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
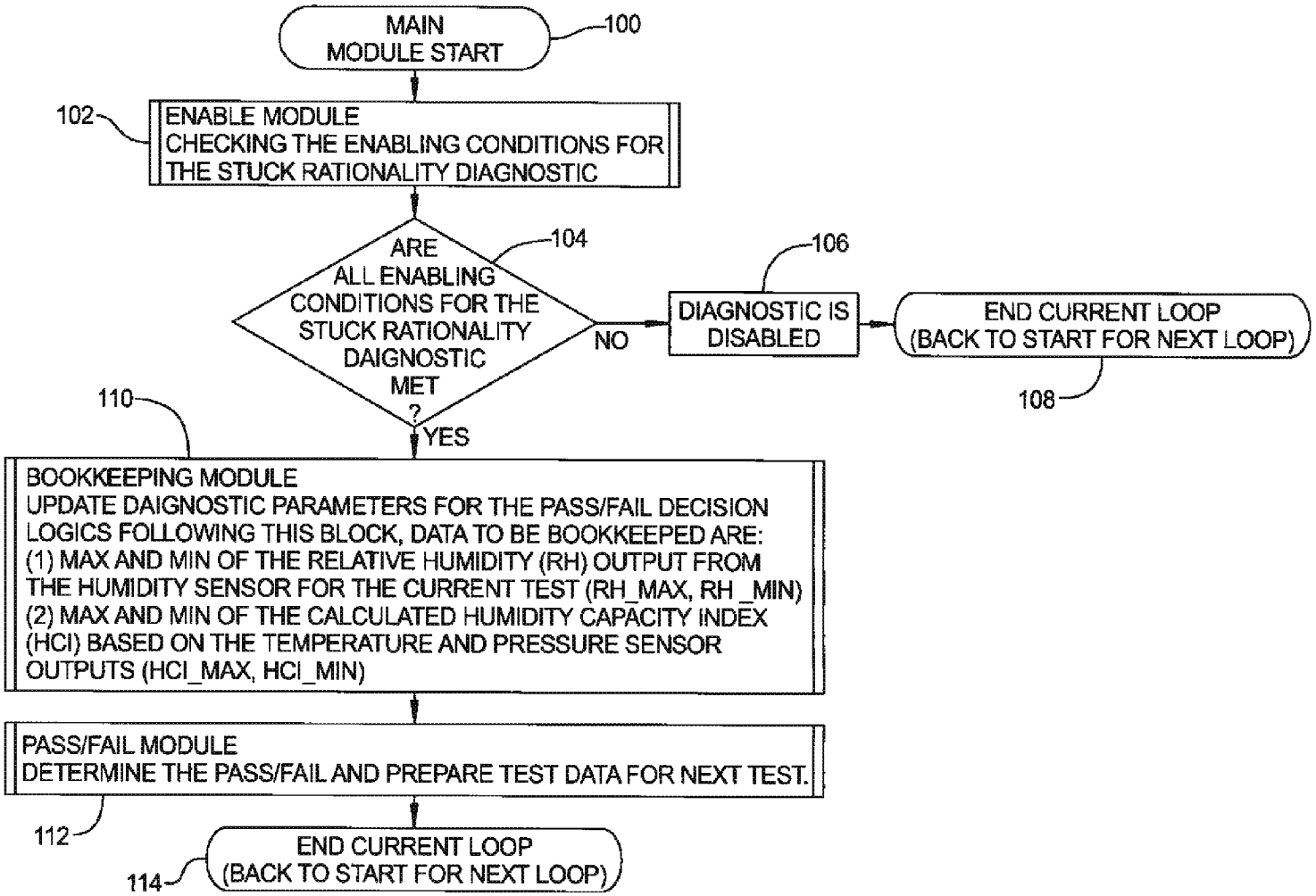
FIG. 1 is a high level flow chart for a main module for diagnosing rationality of a humidity sensor output signal in accordance with an aspect of the present disclosure.

The following description of the preferred embodiment(s) is merely exemplary in nature and is in no way intended to limit the invention, its application, or uses.

In OBD diagnostics, a component must typically fail the diagnostic multiple times for the OBD diagnostic for that component to set a fault code for that component, and typically set an alert such as illuminating the "check engine" light in the vehicle. The OBD humidity sensor output signal rationality diagnostic in accordance with an aspect of the present disclosure uses this approach and the humidity sensor must fail the diagnostic a predetermined number of times, which is typically a calibratable number, for the OBD humidity sensor output signal rationality diagnostic to a set a fault code for the humidity sensor and set an alert.

A typical approach for determining that a humidity sensor has failed is what is commonly referred to as "stuck rationality." This means that the output of the humidity sensor is not changing or "stuck." This typically requires another relative humidity related reference for comparison since the vehicle can be in ambient conditions where the relative humidity is not changing. If the relative humidity related reference is changing and the output signal of the humidity sensor is not, then the OBD humidity sensor output signal rationality diagnostic determines that the humidity sensor has failed the diagnostic check. The Background Section of the present application discusses prior art approaches of providing the humidity reference.

In accordance with an aspect of the present disclosure, a humidity capacity index (HCI) is determined using temperature and pressure and used as the relative humidity related reference in an OBD humidity sensor output signal rationality diagnostic in accordance with an aspect of the present disclosure. The temperature and pressure are obtained from temperature and pressure sensors co-located with the humidity sensor. These temperature and pressure sensors are typically present in vehicles and used to sense ambient temperature and pressure that are typically used for other purposes by one or more electronic control units in the vehicle, but not necessarily co-located with the humidity sensor. In an aspect, the humidity, pressure and temperature sensors are co-located in an intake manifold of the engine of the vehicle. It should be understood that co-located in this context means that the sensors are located so that the humidity, temperature and pressure in the environment sensed by each sensor will be essentially the same. The sensors thus need not be directly abutting each other to be co-located. They would typically be located in close proximity to each other.

A method of diagnosing rationality of a humidity sensor output signal in accordance with an aspect of the present disclosure includes three primary modules that are executed by the engine management system of the vehicle: An enable module, a bookkeeping module and a pass/fail determination module. The enabling module includes logic to ensure that humidity sensor data used in the bookkeeping module is valid. For example, this logic of the enabling module disables the OBD humidity sensor output signal rationality diagnostic when a voltage of the humidity sensor is low and only enables the OBD humidity sensor output signal rationality diagnostic when both temperature and pressure sensors also used in the vehicle have no fault. This logic of the enable module also minimizes the chance of a false fail/pass by disabling the OBD humidity sensor output signal rationality diagnostic during other abnormal situations and when other systems in the vehicle are experiencing faults that adversely impact on the ability of the OBD humidity sensor output signal rationality diagnostic to diagnose the output signal of the humidity sensor.

The bookkeeping module processes diagnostic data for the pass/fail determination module. For a passing routine, the bookkeeping module keeps updating minimum and maximum values of relative humidity (RH_min and RH_max, respectively) obtained from the engine management system reading of the humidity sensor output signal and saves the values in non-volatile memory in ECU. The pass/fail module includes a simplified pass criteria check in which as long as the difference between RH_max and RH_min exceeds a predetermined humidity test threshold, the humidity sensor passes the diagnostic check. Thus there is no need to go through other complex logic, formulae or humidity prediction models to determine that the humidity sensor has passed the diagnostic check.

Storing RH_max and RH_min also improves the in-use performance ratio of the OBD humidity sensor output signal rationality diagnostic. For example, the diagnostic decision will be made whenever the relative humidity readings from the sensor have a sufficiently large difference between last key-off and the current key-on, or over multiple trips. Key-off in the context of this application means the ignition switch has been turned off thus turning the vehicle off and key-on means that the vehicle has been started.

The bookkeeping module also calculates a humidity capacity index (HCI) based on the readings from the temperature and pressure sensors co-located with the humidity sensor. The HCI indicates how much water vapor is contained in the local environment of the humidity sensor. There are multiple ways to handle it, and two illustrative methods are as follows.

The first method (Method 1) is a two-step method. First the saturated vapor pressure of water at the current temperature Ps(T) is calculated using well-known empirical equations such as the Arden-Buck equation or the Magnus-Tetens approximation. In the Arden-Buck equation:

$$P_s(T) = 6.1121\exp\left(\left(18.678 - \frac{T}{234.5}\right)\left(\frac{T}{257.14 + T}\right)\right)$$

HCI is calculated as Ps(T)/R_Pcurrent, where R_Pcurrent is the pressure compensation and it is proportional to the current pressure. It could have various forms, and the typical examples of R_Pcurrent are to take the current reading from the pressure sensor (P_current), or to use the ratio of P_current/P_standard, where P_standard is a constant value and it could be set to the standard atmosphere pressure, or some other constant such that HCI is normalized to 1 at a specific pressure and temperature.

The second method (Method 2) is a one-step table look-up. Based on the working temperature/pressure condition of the humidity sensor and EGR control needs, a 2-D calibration table is generated with temperature and pressure as the table's two axes. The table look-up yields an approximation of HCI for that specific temperature and pressure. The limits of the axis and its breakpoints are illustratively determined by engine control need (such as the EGR control requirements). Calibration values of that table are illustratively determined by the division of the saturated vapor pressure by the current pressure, and the saturated vapor pressure is illustratively be determined by the empirical equation mentioned in Method 1, or alternatively is illustratively determined heuristically determined by experiments that measure the saturated vapor pressure at the chosen breakpoints of temperatures and pressures. Once HCI is determined, the bookkeeping module keeps updating the minimum and maximum values of HCI (HCI_min and HCI_max, respectively) and saves the values in non-volatile memory in the ECU. The advantage of saving HCI_max and HCI_min in non-volatile memory is that the OBD humidity sensor output signal rationality diagnostic could evaluate a fail more promptly as long as its logic sees large variations in HCI, regardless if it is during the same vehicle trip.

The pass/fail module evaluates the outputs of the bookkeeping module and determines whether the humidity sensor output signal has passed or failed the OBD humidity sensor output signal rationality diagnostic. The pass/fail module includes logic that prevents the OBD humidity sensor output signal rationality diagnostic from determining false failures of the humidity sensor output signal during extreme relative humidity conditions (which are when the relative humidity is very high or very low). For example, at the extremes of relative humidity ambient conditions, the humidity sensor output signal will be at 100% or 0% relative humidity. When these extreme relative humidity ambient conditions are present, the logic of the pass/fail module does not increase the fail counter of the OBD humidity sensor output signal rationality diagnostic when a temperature/pressure change, reflected by a change in the HCI, meets the associated threshold that would otherwise indicate a fail and associated increase of the fail counter. Meanwhile, the detection of stuck rationality near 100% and 0% relative humidity is still retained when temperature increases or pressure decreases near 100% relative humidity, and temperature decreases or pressure increases near 0% relative humidity.

FIGS. 1-4 are flowcharts for software programs of the modules for an OBD humidity sensor output signal rationality diagnostic for diagnosing rationality of a humidity sensor output signal in accordance with an aspect of the present disclosure in which the logic for the rationality diagnostic is implemented. This includes logic for the enable module, bookkeeping module and pass/fail module. This software is illustratively programmed in the ECU of the engine management system of the vehicle.

Figure 5:
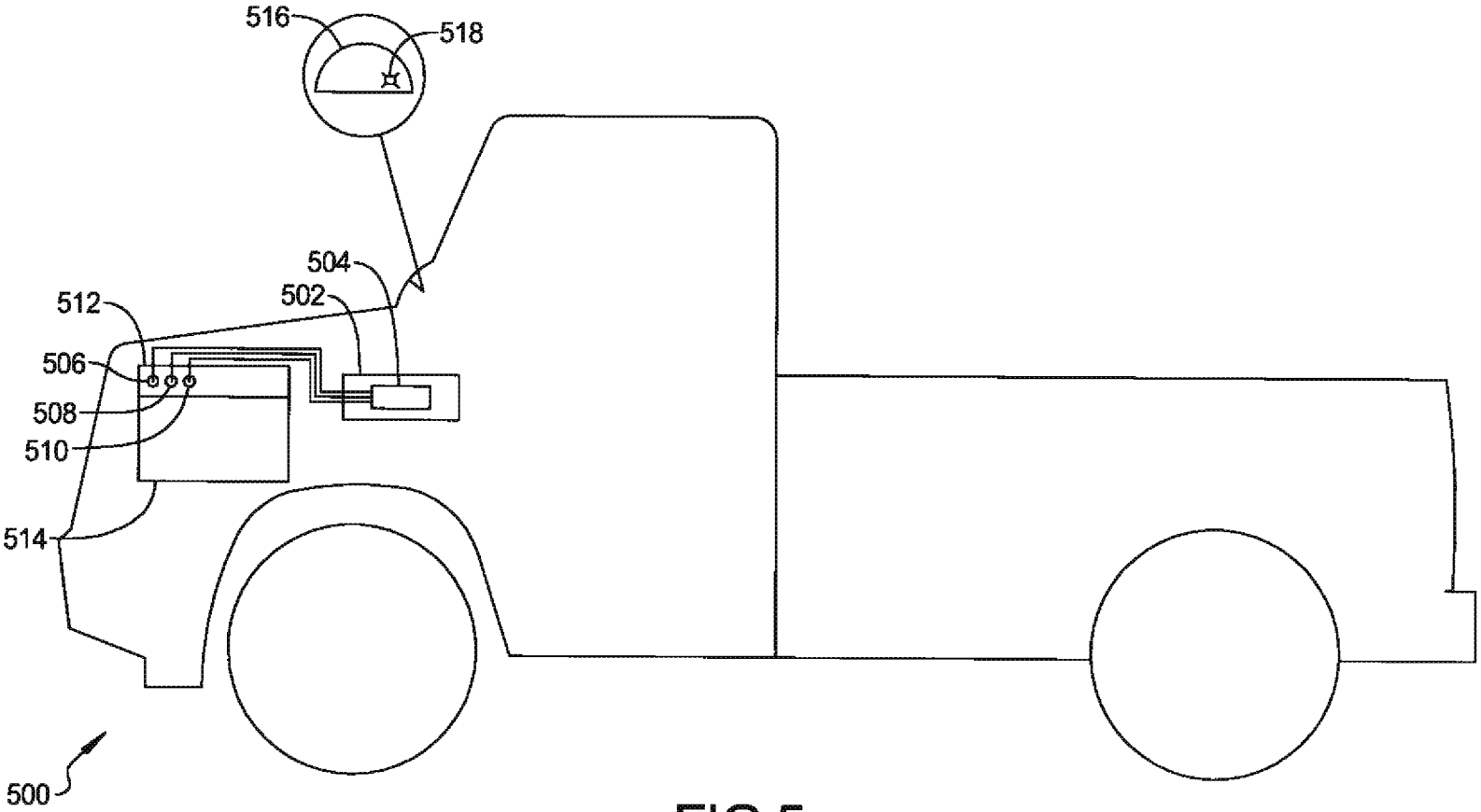
FIG. 5 is a diagrammatic view of a vehicle.

FIG. 5 is a diagrammatic view of a vehicle 500 having engine management system 502 that includes one or more ECU's 504. A humidity sensor 506, temperature sensor 508, and pressure sensor 510, that are co-located with each other in an intake manifold 512 of an engine 514 of vehicle 500, and are coupled to ECU 504. ECU 504 is coupled to a display 516, such as an instrument cluster, that includes a user alert 518 such as a "check engine" light.

FIG. 1 is a flowchart of a program for a main module of the OBD humidity sensor output signal rationality diagnostic in accordance with an aspect of the present disclosure. The flowchart of FIG. 1 for the main module illustrates the high level logic for the OBD humidity sensor output signal rationality diagnostic in accordance with an aspect of the present disclosure. The main module starts at 100 and at 102, executes the enable module which, as discussed above, checks whether all the enabling conditions are present for the OBD humidity sensor output signal rationality diagnostic to perform a diagnostic check of the humidity sensor. If not, at 104 the OBD humidity sensor output signal rationality diagnostic is disabled and at 106, the current main module ends and the main module branches back to 100 to start the next loop of the main module. The main module loops continuously as long as the vehicle engine is running, as is typical of OBD diagnostic routines.

If at 104 the main module determines that all the enabling conditions are present for the OBD humidity sensor output signal rationality diagnostic to perform a diagnostic check of the humidity sensor, it proceeds to 110 where it executes the bookkeeping module. The bookkeeping module, as discussed above, updates the diagnostic parameters for use by the pass/fail module. The main module loop then proceeds to 112 where it executes the pass/fail module which, as discussed above, determines whether the humidity sensor output signal has passed or failed the OBD humidity sensor output signal rationality diagnostic. The current loop of the main module ends at 114 and the main module branches back to 100 to run the next loop of the main module.

Figure 2:
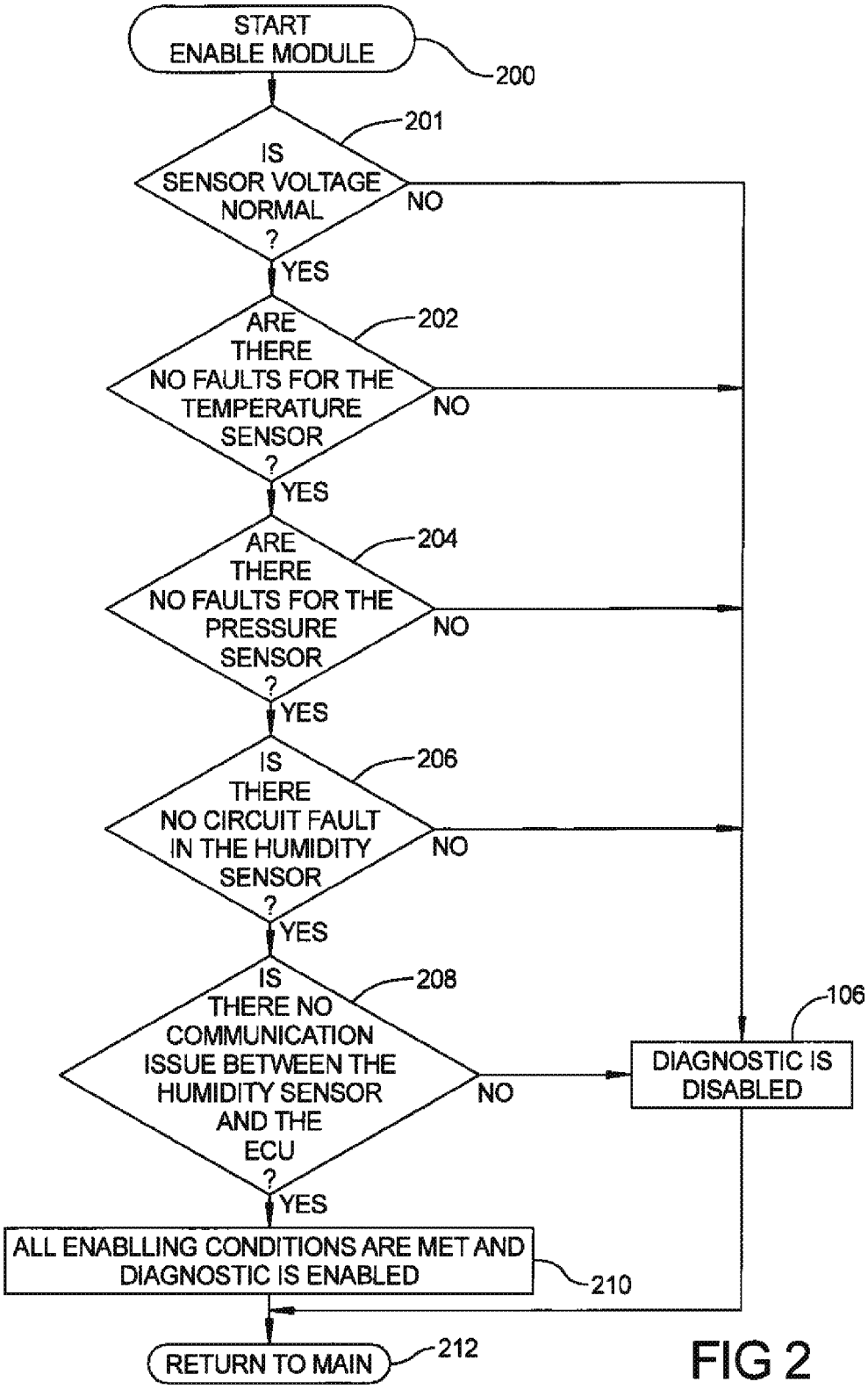
FIG. 2 is a flow chart for an enable module of the main module of FIG. 1.

FIG. 2 is a flow chart showing in more detail a program for the enable module in accordance with an aspect of the present disclosure. At 200, the enable module stars and at 201, the enable module checks whether the humidity sensor voltage is normal (for example, that the voltage is not zero due to a short to ground circuit fault, nor the same voltage as the power supply due to a short to battery circuit fault). If the humidity sensor voltage is not normal, the enable module branches to 106 where the main module disables the OBD humidity sensor output signal rationality diagnostic as discussed above. If at 200 the humidity sensor voltage at normal, at 202 the enable module checks whether there are any faults for the temperature sensor, such as by checking OBD fault data for the temperature sensor. It should be understood that the temperature sensor is a known temperature sensor of the vehicle that senses ambient temperature and as known the OBD of the vehicle's engine management systems includes a diagnostic (or diagnostics) for checking whether the temperature sensor has a fault and stores data (such as in memory of the ECU) about whether the temperature sensor has a fault. If the temperature sensor has a fault, the enable module branches to 106.

If the temperature sensor does not have a fault, at 204 the enable module checks whether the pressure sensor has a fault, such as by checking OBD fault data for the pressure sensor. It should be understood that the pressure sensor is a known pressure sensor of the vehicle that senses ambient pressure and as is known, the OBD of the vehicle's engine management systems includes a diagnostic (or diagnostics) for checking whether the pressure sensor has a fault and stores data about whether the pressure sensor has a fault (such as in memory of the ECU). If the pressure sensor has a fault, the enable module branches to 106.

If the pressure sensor does not have a fault, the enable module checks whether there is a circuit fault in the humidity sensor. If the humidity sensor has a circuit fault, the enable module branches to 106. If the humidity sensor does not have a circuit fault, the enable module checks whether there is a communication problem between the humidity sensor and the ECU of the engine management system. In an aspect, the humidity sensor is coupled to an input of the ECU. In an aspect, the humidity sensor communicated with the ECU over the CAN bus or the LIN bus of the vehicle. If there is a communication problem between the humidity sensor and the ECU, the enable module branches to 106. If there is not a communication problem between the humidity sensor and the ECU, at 210 the enable module determines that all enabling conditions have been met for the OBD humidity sensor output signal rationality diagnostic to perform a diagnostic check of the humidity sensor and returns to the main module at 212 and the main module proceeds to the bookkeeping module as discussed above.

Figure 3A:
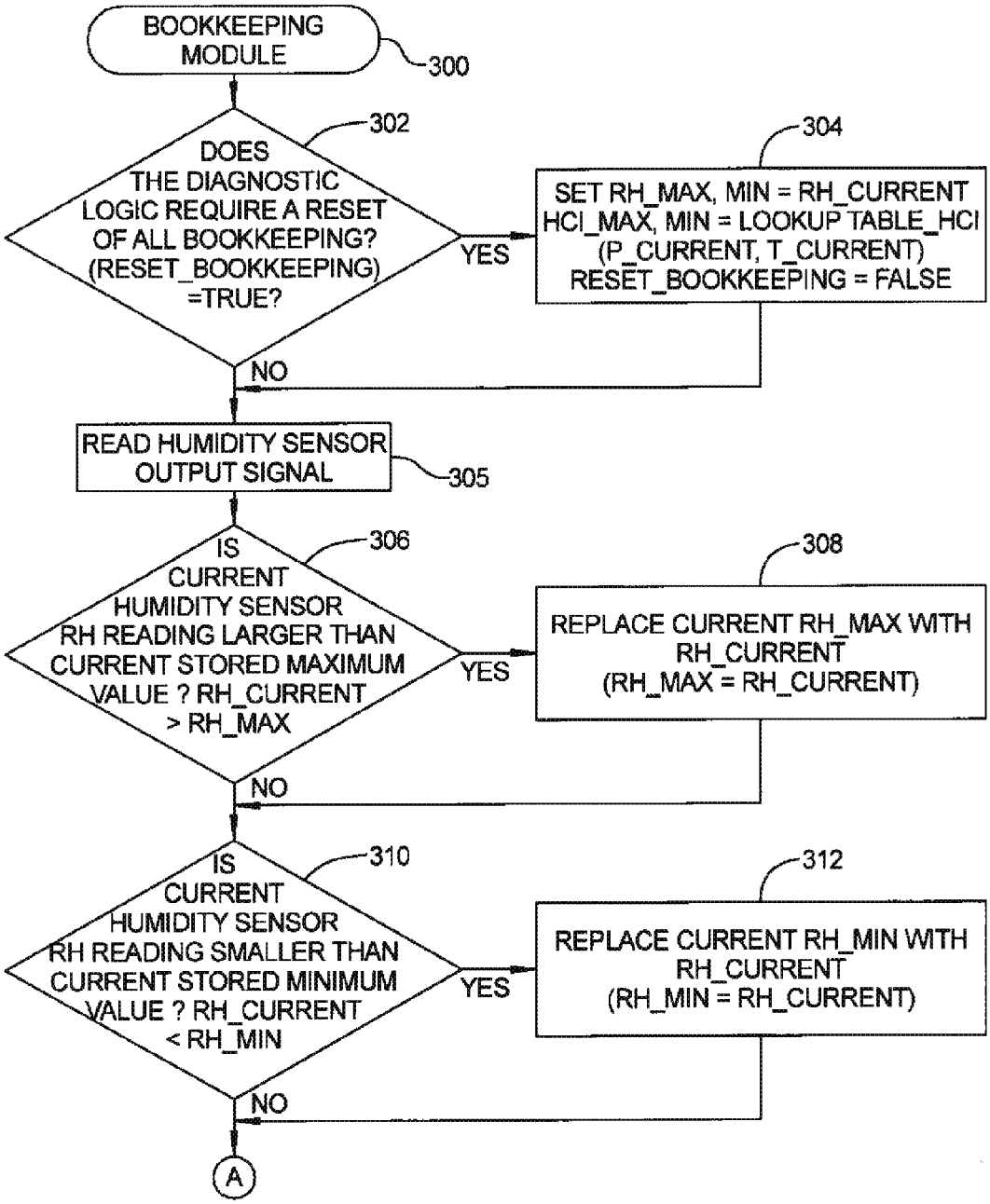
FIGS. 3A and 3B are a flow chart for a bookkeeping module of the main module of FIG. 1.
Figure 3B:
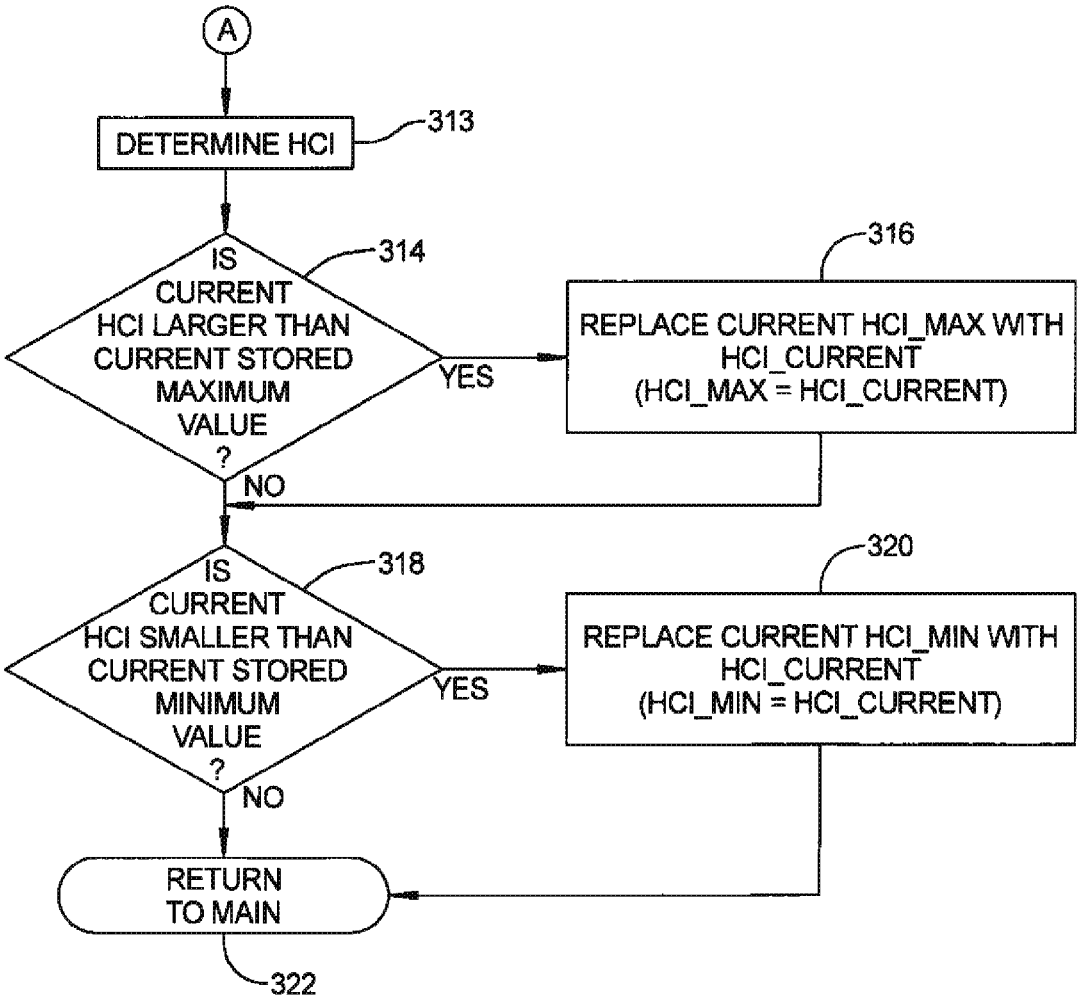

FIG. 3 is a flow chart showing in more detail a program for the bookkeeping module in accordance with an aspect of the present disclosure. At 300, the bookkeeping module starts. At 302, the bookkeeping module checks whether ail the diagnostic parameters obtained or determined by the bookkeeping module need to be reset, such as when the OBD humidity sensor output signal rationality diagnostic begins a new diagnostic check of the humidity sensor. It illustratively does so by checking whether the Bookkeeping reset flag has been set to True, such as by the pass/fail module as discussed below. These diagnostic parameters include the maximum and minimum relative humidity values from the humidity sensor and the HCI. If so, at 304 these diagnostic parameters are reset to the current diagnostic data. That is, the maximum and minimum relative humidity values are updated to the current maximum and minimum relative humidity values from the humidity sensor and the HCI is determined using current temperature and sensor values from the temperature and pressure sensors. The bookkeeping module then proceeds to 306. The bookkeeping module also proceeds to 306 if at 304 it determined that the diagnostic parameters did not need to be reset.

At 305, the bookkeeping module reads the output signal of the humidity sensor to obtain a current relative humidity value. At 306, the bookkeeping module checks whether the current relative humidity value is greater than the stored maximum relative humidity value. If so, at 308 the current stored maximum relative humidity value is replaced with the current relative humidity value and the bookkeeping module proceeds to 310. The bookkeeping module also proceeds to 310 if at 306 it determined that the current relative humidity value is not greater than the stored maximum relative humidity value.

At 310, the bookkeeping module checks whether the current relative humidity value is less than the current stored minimum relative humidity value. If so, at 312 the current stored minimum relative humidity value is replaced with the current relative humidity value and the bookkeeping module proceeds to 313. The bookkeeping module also proceeds to 313 if at 310 it determined that the current relative humidity value is not less than the stored minimum relative humidity value.

At 313, the bookkeeping module determines a current HCI based on temperature and pressure local to the humidity sensor, as discussed above.

At 314, the bookkeeping module checks whether the current HCI is larger than the current stored maximum HCI. If so, at 316 the current stored maximum HCI is replaced with the current HCI and the bookkeeping module proceeds to 318. The bookkeeping module also proceeds to 318 if at 314 it determined that the current HCI is not greater than the stored maximum HCI.

At 318, the bookkeeping module checks whether the current HCI is smaller than the current stored minimum HCI. If so, at 320 the current stored minimum HCI is replaced with the current HCI and the bookkeeping module proceeds to 322. If not, the bookkeeping module proceeds to 322 where the current loop of the bookkeeping module ends and the bookkeeping module returns to the main module. The bookkeeping module also proceeds to 322 if at 318 it determined that the current HCI is not smaller than the stored minimum HCI. At 322, the bookkeeping loop ends and returns to the main module which then proceeds to the pass/fail module as discussed above.

Figure 4A:
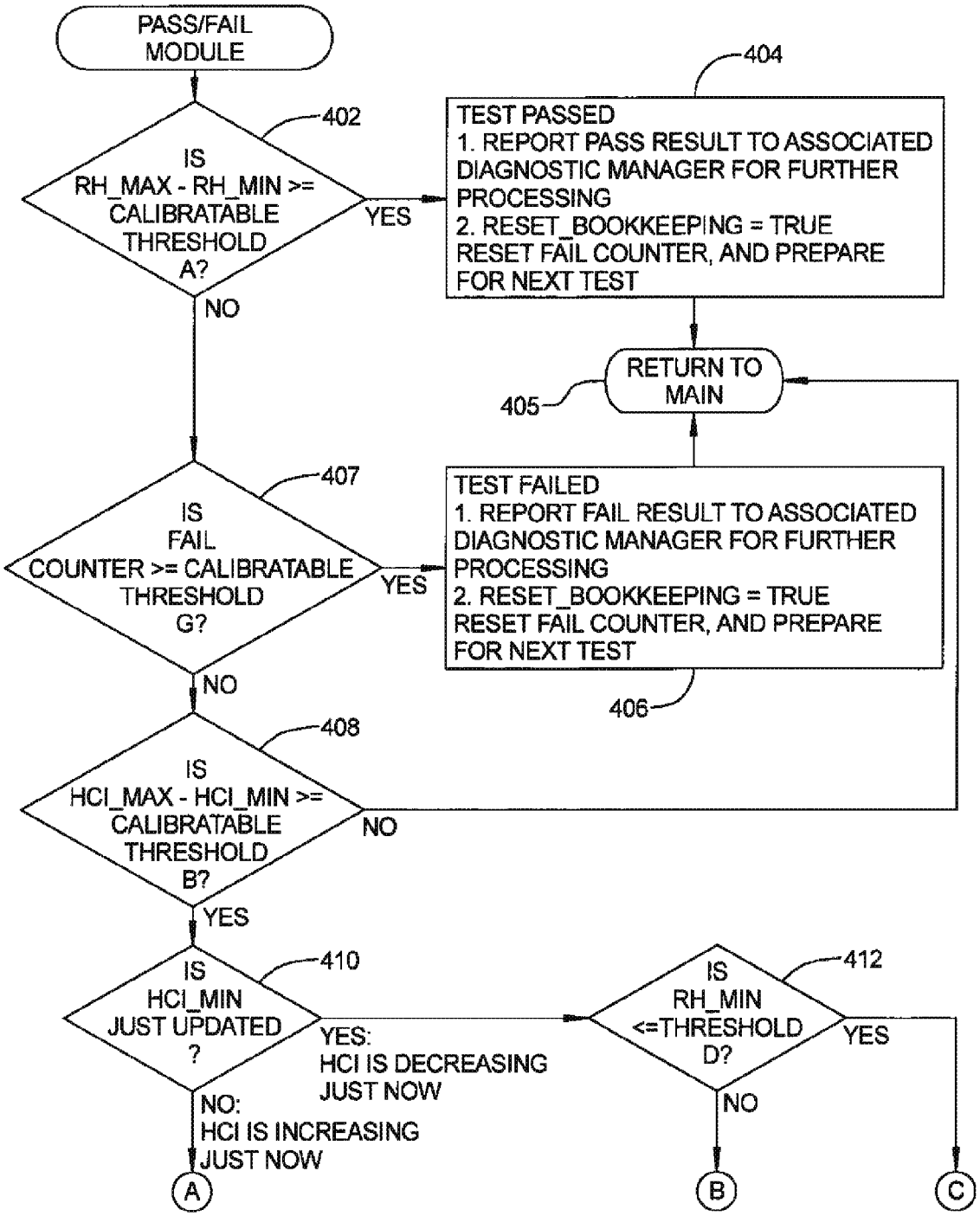
FIGS. 4A and 4B are a flow chart for a pass/fail module of the main module of FIG. 1.
Figure 4B:
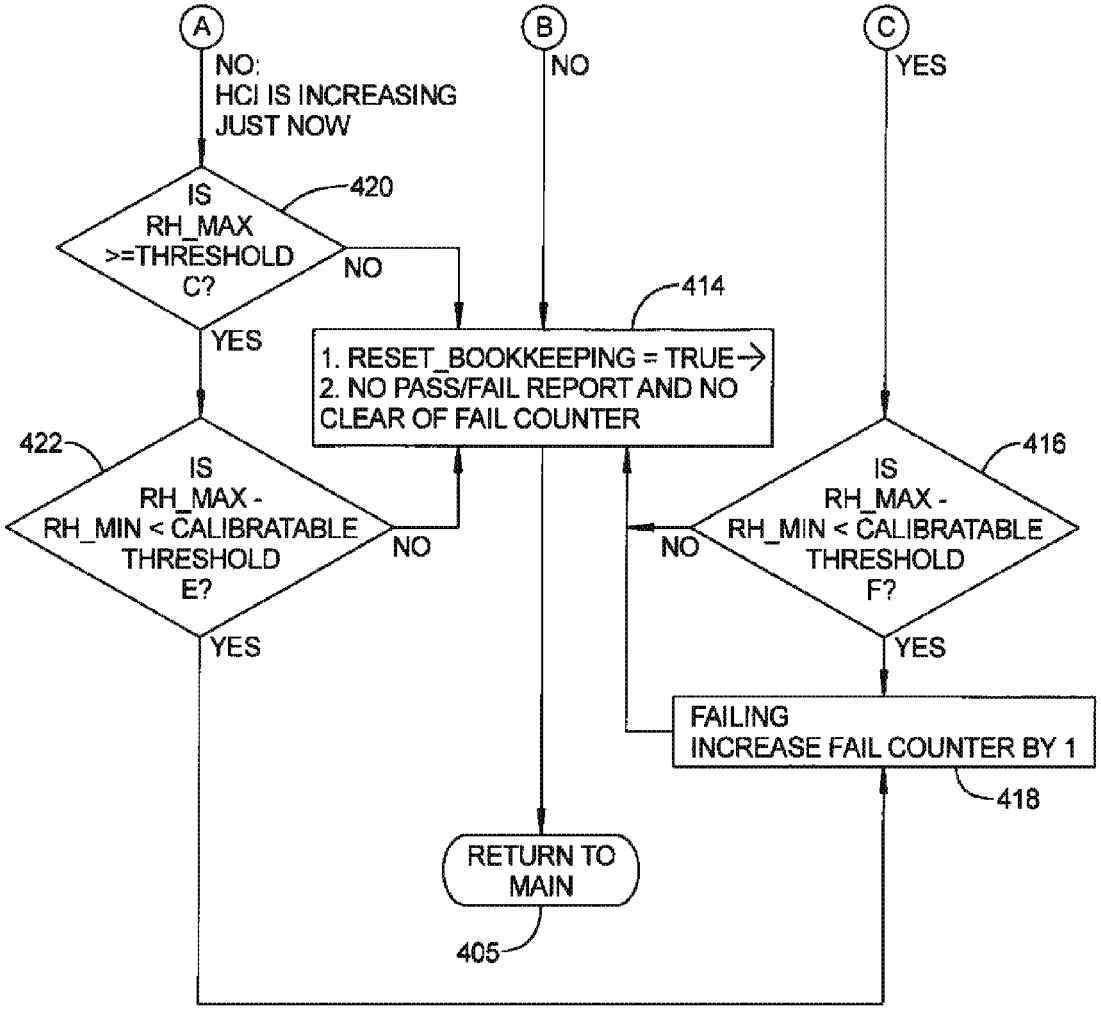

FIG. 4 is a flow chart showing in more detail a program for the pass/fail module in accordance with an aspect of the present disclosure. The pass/fail module starts at 400. At 402, the pass/fail module checks whether the difference between RH_max and RH_min is greater than or equal to a predetermined humidity test threshold, which is a calibratable threshold and referred to herein as calibratable threshold A. If it is, the humidity sensor has passed the OBD humidity sensor output signal rationality diagnostic check and the pass/fail module proceeds to 404 where the pass is reported to an associated diagnostic manager in the OBD of the vehicle's OBD for further processing. Also, the Bookkeeping reset flag is set to True and a fail counter in the OBD humidity sensor output signal rationality diagnostic is reset, such as to zero. The pass/fail module then proceeds to 405 where the current loop of the pass/fail module ends and it returns to the main module.

If at 402 the difference between RH_max and RH_min is less than the calibratable threshold A, pass/fail module proceeds to 407 where it checks whether the OBD humidity sensor output signal rationality diagnostic fail counter is greater than or equal to a predetermined number, which is calibratable and referred to herein as calibratable threshold G. If so, the humidity sensor output signal has failed the OBD humidity sensor output signal rationality diagnostic the requisite number of times for the OBD humidity sensor output signal rationality diagnostic to set a fault for the humidity sensor in the vehicle's OBD. The pass/fail module branches to 406 where it reports that the humidity sensor has a fault to the associated diagnostic manager in the vehicle's OBD. It also resets the Bookkeeping reset flag to True and resets the fail counter. The pass/fail module then proceeds to 405 where the current loop of the pass/fail module ends and it returns to the main module.

If at 407 the difference between the OBD humidity sensor output signal rationality diagnostic fail counter is less than the calibratable threshold G, pass/fail module proceeds to 408 where it checks if the difference between HCI_max and HCI_min is greater than or equal to a predetermined HCI threshold, which is a calibratable threshold and referred to herein as calibratable threshold B. If so, the pass/fail module then proceeds to 405 where the current loop of the pass/fail module ends and it returns to the main module. If not, the pass/fail module proceeds to 410.

At 410, the pass/fail module checks whether HCI_min has just been updated. If yes, this means that the HCI is presently decreasing and pass/fail module branches to 412. At 412, the pass/fail module checks whether RH_min is less than or equal to a high relative humidity threshold (typically set to 85%) and referred to herein as threshold D. If not, the pass/fail module branches to 414 where the Bookkeeping reset flag is set to True causing the Bookkeeping module to reset the test data when the Bookkeeping module is next performed. The pass/fail module does not report a pass or fail to the vehicle's OBD diagnostic manager and the OBD fail counter is not reset. The pass/fail module then proceeds to 405 where the current loop of the pass/fail module ends and it returns to the main module.

If at 412 RH_min is greater than the threshold D, pass/fail module proceeds to 416 where it checks if the difference between RH_max and RH_min is less than a second predetermined humidity test threshold, which is a calibratable threshold and referred to herein as calibratable threshold F. If so, the humidity sensor output signal has failed the diagnostic check made in the current loop and pass/fail module proceeds to 418 where it increments the OBD humidity sensor output signal rationality diagnostic fail counter by one and then proceeds to 414. If at 416 the difference between RH_max and RH_min is not less than calibratable threshold F, pass/fail module branches to 414.

If at 410, HCI_min has not just been updated, HCI is presently increasing. The pass/fail module then proceeds to 420 where it checks if RH_max is greater than or equal to a low relative humidity threshold (typically set to 15%) and referred to herein as threshold C. If not, the pass/fail module branches to 414. If so, the pass/fail module proceeds to 422 where it checks whether the difference between RH_max and RH_min is less than a third predetermined humidity test threshold, which is a calibratable threshold referred to herein as calibratable threshold E. If not, the pass/fail module branches to 414. If so, the pass/fail module branches to 418. It should be understood that calibratable thresholds A, E and F could be set to the same value or to different values. Illustratively, calibratable thresholds A, E and F are set to a value in the range of 5% to 10%.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. In an automotive vehicle having an internal combustion engine, a humidity sensor in an intake manifold of the engine and an engine management system configured to control the engine, the humidity sensor coupled to the engine management system, a method of diagnosing rationality of an output signal of the humidity sensor with the engine management system, comprising:

performing an onboard humidity sensor rationality diagnostic with the engine management system that includes continuously performing diagnostic loops with the engine management system when the engine is running wherein each diagnostic loop includes:

reading the humidity sensor output signal with the engine management system;

determining with the engine management system a humidity capacity index based on pressure and temperature local to the humidity sensor;

determining with the engine management system whether the humidity sensor output signal has passed the rationality diagnostic based on whether the humidity sensor output signal has changed from a prior reading by at least a predetermined humidity test threshold and determining that the humidity sensor passed the rationality diagnostic upon determining that the humidity sensor output signal has changed from the prior reading by at least the predetermined humidity test threshold;

upon determining that the humidity sensor output signal did not pass the rationality diagnostic, determining with the engine management system whether the humidity sensor output signal should have changed by the predetermined humidity test threshold based on whether the determined humidity capacity index has changed from a prior determined humidity capacity index by at least a predetermined humidity capacity index threshold and determining that the humidity sensor output signal failed the diagnostic check upon determining that the humidity sensor output signal should have changed by at least a second predetermined humidity test threshold and did not; and determining with the engine management system that the humidity sensor output signal has failed the rationality diagnostic upon determining that the humidity sensor has failed the diagnostic check a predetermined number of times and upon determining that the humidity sensor output signal has experienced a failure of the rationality diagnostic, generating with the engine management system a failure report that includes setting a fault code in memory of the engine management system and also setting with the engine management system a user recognizable alert.

2. The method of claim 1 wherein each diagnostic loop includes a bookkeeping module and a pass/fail module with the bookkeeping module performed before the pass/fail module and performing the bookkeeping module with the engine management system includes:

the reading the humidity sensor output signal with the engine management system and the determining with the engine management system a current humidity capacity index based on pressure and temperature local to the humidity sensor;

determining with the engine management system whether to initialize test data stored in a memory of the engine management system, the test data including minimum and maximum relative humidity values and minimum and maximum humidity capacity index values and upon determining with the engine management system that the test data is to be initialized, initializing the test data with the engine management system by replacing both the minimum and maximum relative humidity values stored in memory with a current relative humidity value obtained by the reading of the humidity sensor output signal and replacing both the minimum and maximum humidity capacity index values stored in memory with the determined humidity capacity index wherein determining the humidity capacity index with the engine management system based on pressure and temperature local to the humidity sensor includes determining the humidity capacity index based on pressure and temperature sensed by pressure and temperature sensors co-located with the humidity sensor, the pressure and temperature sensors coupled to the engine management system;

updating with the engine management system the minimum value of relative humidity stored in the memory of the engine management system by replacing it with the current relative humidity value if the current relative humidity value is less than the stored minimum relative humidity value and updating the maximum value of relative humidity stored in the memory of the engine management system by replacing it with the current relative humidity valve if the current relative humidity value is greater than the stored maximum humidity value; and updating with the engine management system the minimum value of the humidity capacity index stored in the memory of the engine management system by replacing it with the determined humidity capacity index if the determined humidity capacity index is less than the stored minimum humidity capacity index value and updating the maximum humidity capacity index value stored in the memory of the engine management system by replacing it with the determined humidity capacity index value if the determined humidity capacity index value is greater than the stored maximum humidity capacity index value;

wherein performing the pass/fail module with the engine diagnostic system includes the determination of whether the humidity sensor output signal has passed the rationality diagnostic, whether the humidity sensor output signal has failed the diagnostic check and whether the humidity sensor output signal has failed the rationality diagnostic, including:

determining with the engine management system that the humidity sensor output signal has passed the rationality diagnostic if the stored minimum and maximum humidity values differ from each other by at least the predetermined humidity test threshold and upon determining that the humidity sensor output signal has passed the rationality diagnostic generating with the engine management system a pass report for processing by an onboard diagnostic manager of the engine management system, resetting with the engine management system a fail counter of the rationality diagnostic and causing the engine management system to initialize the test data when next performing the bookkeeping module with the engine management system;

determining with the engine management system that the humidity sensor output signal has failed the diagnostic check if the stored minimum and maximum humidity values do not differ from each other by at least the second predetermined humidity test threshold, that the stored maximum and minimum humidity capacity index values differ from each by at least the predetermined humidity capacity index threshold and that the relative humidity sensed by the humidity sensor is not at a high or low extreme ambient condition, and upon determining with the engine management system that the humidity sensor output signal has failed the diagnostic check, incrementing with the engine management system the fail counter and causing the engine management system to initialize the test data when next performing the bookkeeping module; and determining with the engine management system that the humidity sensor output signal has failed the rationality diagnostic when the fail counter reaches a predetermined number and upon determining that the humidity sensor output signal has failed the rationality diagnostic, in addition to generating the failure report and setting the user recognizable alert also resetting with the engine management system the fail counter and causing the engine management system to initialize the test data when next performing the bookkeeping module.

3. The method of claim 2 wherein determining that the humidity sensor output signal failed the diagnostic check upon determining that the stored minimum and maximum humidity values do not differ from each other by at least the second predetermined humidity test threshold includes if the determined humidity capacity index increased from the prior determined humidity capacity index, making the determination using the second predetermined humidity test threshold and if the determined humidity capacity index decreased from the prior determined humidity capacity index, making the determination using a third predetermined humidity test threshold instead of the second predetermined humidity test threshold.

4. The method of claim 3 wherein each diagnostic loop also includes an enable module performed before the bookkeeping module and performing the enable module with the engine management system includes determining whether all enabling conditions are present for proceeding to perform the bookkeeping module and proceeding to perform the bookkeeping module only upon determining that all the enabling conditions are present.

5. The method of claim 2 wherein determining with the engine management system that the humidity sensor has failed the diagnostic check also requires either:

determining with the engine management system that the minimum and maximum humidity values do not differ from each other by at least the second predetermined humidity test threshold after determining with the engine management system that the current humidity capacity index is increasing and that the minimum relative humidity value is less than or equal to a high relative humidity threshold; or determining with the engine management system that the minimum and maximum humidity values do not differ from each other by at least a third predetermined humidity test threshold after determining with the engine management system that the current humidity capacity index is decreasing and that the maximum relative humidity value is greater than or equal to a low relative humidity threshold.

6. The method of claim 5 wherein the low relative humidity threshold is fifteen percent and the high relative humidity threshold is eighty-five percent.

7. The method of claim 1 wherein determining that the humidity sensor output signal failed the diagnostic check upon determining that the humidity sensor output signal should have changed by at least the second predetermined humidity test threshold and did not includes if the determined humidity capacity index increased from the prior determined humidity capacity index, making the determination using the second predetermined humidity test threshold and if the determined humidity capacity index decreased from the prior determined humidity capacity index, making the determination using a third predetermined humidity test threshold instead of the second predetermined humidity test threshold.

* * * * *